US006666445B2

(12) United States Patent
Yamakawa et al.

(10) Patent No.: US 6,666,445 B2
(45) Date of Patent: Dec. 23, 2003

(54) SHEET DISCHARGE APPARATUS AND IMAGE FORMING APPARATUS

(75) Inventors: Takehiro Yamakawa, Yamanashi-ken (JP); Jun Natori, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 0 days.

(21) Appl. No.: 10/160,286

(22) Filed: Jun. 4, 2002

(65) Prior Publication Data

US 2002/0195768 A1 Dec. 26, 2002

(30) Foreign Application Priority Data

Jun. 4, 2001 (JP) ..... 2001-168818

(51) Int. Cl.[7] ..... B65H 5/22; B65H 83/00; B65H 85/00

(52) U.S. Cl. ..... 271/3.15; 271/215

(58) Field of Search ..... 271/3.15, 213, 271/214, 215, 152, 176, 199, 258.01, 265.02; 399/371, 370, 376; 358/488; 250/559.3; 700/229; B65H 5/22, 83/00, 85/00, 31/04, 43/04, 1/08, 43/00, 7/02

(56) References Cited

U.S. PATENT DOCUMENTS 5,882,005 A * 3/1999 Araseki et al. ..... 271/126
6,109,606 A * 8/2000 Johnson et al. ..... 271/213
6,170,821 B1 * 1/2001 Kubota ..... 271/288
2001/0006272 A1 * 7/2001 Gunschera et al. ..... 271/213

* cited by examiner

*Primary Examiner*—Donald P. Walsh
*Assistant Examiner*—Kenneth W Bower
(74) *Attorney, Agent, or Firm*—Kanesaka & Takeuchi

(57) ABSTRACT

A sheet discharge apparatus of the present invention is equipped with a discharge device for discharging a sheet from an image forming apparatus, a storage device for storing the sheet discharged from the discharge device, an elevator device for raising and lowering the storage device relative to the discharge device, a position detection device for detecting a surface of the uppermost sheet stored in the storage device or a surface of the storage device to stack the sheet, a reception device for receiving a signal indicating a transport status in the image forming apparatus, and a control device for temporarily stopping the discharge device after the transported sheet is discharged to the storage means by the discharge means when the position detection device detects the uppermost surface of the uppermost sheet stored in the storage device or the surface of the storage means to stack the sheet is away from a predetermined position and the reception device detects the sheet transported in the image forming apparatus.

23 Claims, 11 Drawing Sheets

Sheet removed partway control (tray control)

NO
Sheet removed from tray?
S51
YES
Chattering absorption processing
Timer counting?
S52
YES
S54
NO
S53
Timer counted down
Timer set
NO
Time up?
S55
YES
Discharging sheet from apparatus? (Executing print job?)
S56
NO
YES
S57
Tray rising speed = High
S58
Tray rises
NO
Tray HP position?
S59
YES
S60
Tray stopped
End Sheet removed partway control (tray control)

Sheet removed from tray?
S81
NO
YES
Timer counting?
S82
YES
NO
S83
Timer set
Chattering absorption processing
S84
Timer counted down
NO
S85
Time up?
YES
Discharging sheet from apparatus? (Executing print job?)
S86
NO
YES
S87
Tray stopped
NO
Sheet discharge completed?
S88
YES
Tray rises
S89
NO
Tray HP position?
S90
YES
S91
Tray stopped
End

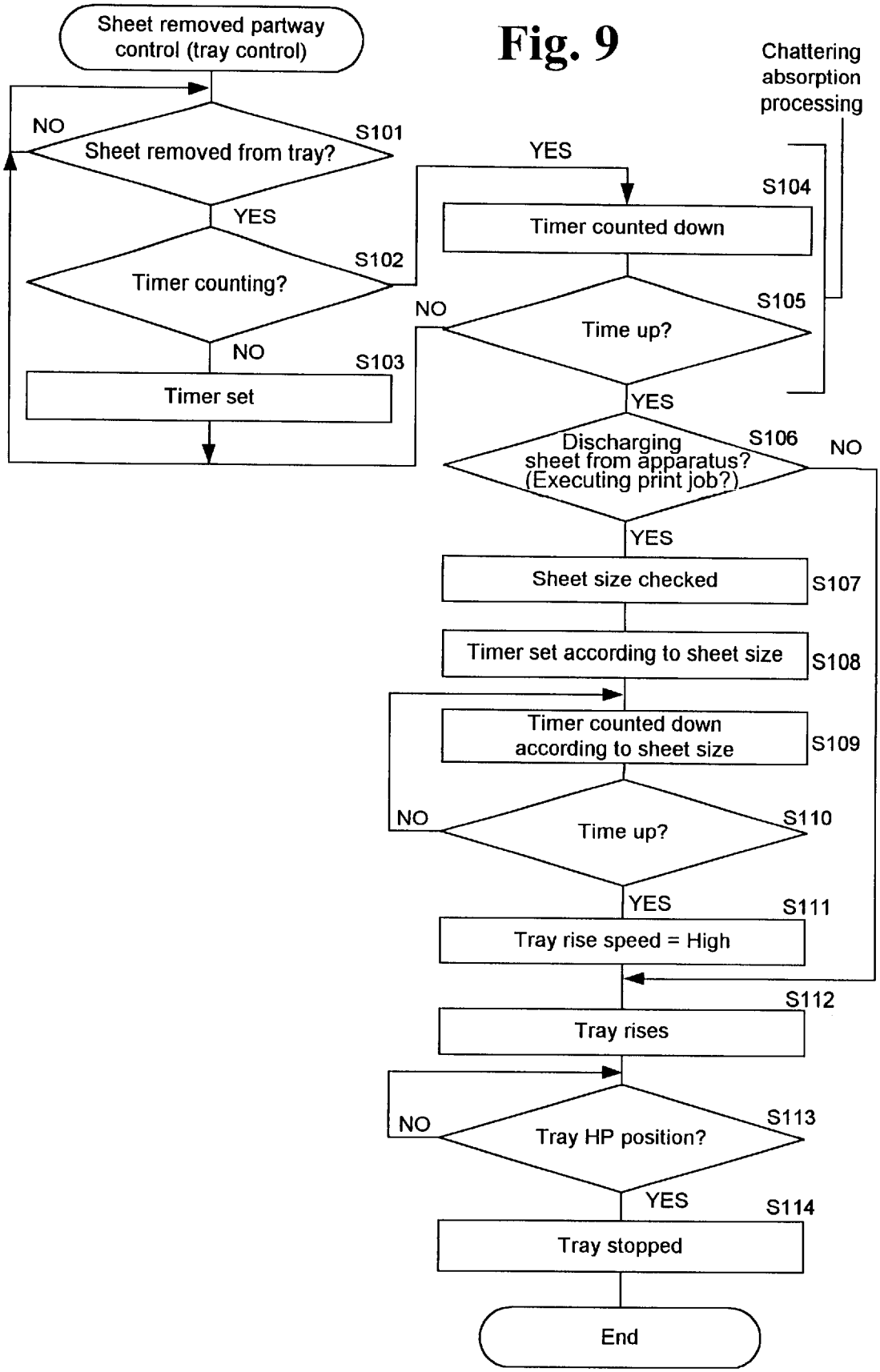
Fig. 9
Sheet removed partway control (tray control)
Sheet removed from tray?
S101
NO
YES
Timer counting?
S102
NO
Timer set
S103
YES
Timer counted down
S104
Time up?
S105
NO
YES
Chattering absorption processing
Discharging sheet from apparatus? (Executing print job?)
S106
NO
YES
Sheet size checked
S107
Timer set according to sheet size
S108
Timer counted down according to sheet size
S109
Time up?
S110
NO
YES
Tray rise speed = High
S111
Tray rises
S112
Tray HP position?
S113
NO
YES
Tray stopped
S114
End

SHEET DISCHARGE APPARATUS AND IMAGE FORMING APPARATUS

BACKGROUND OF THE INVENTION

This invention relates to a sheet discharge control method, a sheet discharge apparatus and an image forming apparatus for stacking sheets with images formed thereon discharged from an image forming apparatus such as a copier or a printer.

Conventionally, a sheet discharge apparatus that stacks sheets with images formed thereon by an image forming apparatus such as a copier or a printer onto a stacking tray has been well known.

In the sheet discharge apparatus, if a sheet is removed from the stacking tray while the apparatus is operating and continuously discharging sheets, the sheets will not be stacked on the stacking tray at a specific position in an aligned state.

For this reason, in Japanese Patent Publication (Tokkai) No. 63-247267, a sheet finishing apparatus includes a sheet stacking device moving relative to a sheet discharging unit for stacking the sheets, a detection device for detecting whether a sheet is removed from the sheet stacking device, and a control device for temporarily stopping the sheet discharge unit from discharging the sheets according to an output of the detection device.

In this sheet finishing apparatus, if the sheets are already fed to a recording unit or a transport unit in the image forming apparatus when the sheet is removed from the stacking tray, the sheets will jam in the image forming apparatus such as a copier or a printer by temporarily stopping the discharge operation of the sheet finishing apparatus.

In the type of technology described above, problems regarding the poor sheet alignment and the discharging performance exist. According to this technology, when the sheet is removed and the discharging operation of the sheet finishing apparatus is temporarily stopped, the image forming apparatus such as a copier or a printer may have a sheet jam or a folded sheet, and thus have a poor discharge performance.

An objective of the present invention is to solve the problems associated with the conventional technology and to provide a sheet discharge control method, a sheet discharge apparatus, an image forming apparatus and a program that eliminate the sheet jam or the folded sheet in the image forming apparatus or the sheet discharge apparatus (including a sheet finishing apparatuses) and improve the alignment of the sheets and the discharging performance.

SUMMARY OF THE INVENTION

In order to attain the aforementioned objective, according to the present invention, a sheet discharge apparatus is equipped with discharge means for discharging sheets from an image forming apparatus, storage means for storing the sheets discharged from the aforementioned discharge means; elevator means for raising and lowering the aforementioned storage means relative to the aforementioned discharge means; position detection means for detecting a surface of the upper most sheet stored in the aforementioned storage means or a surface of the aforementioned storage means on which the sheet is to be stacked; reception means for receiving a signal from the aforementioned image forming apparatus indicating a sheet transport status in the aforementioned image forming apparatus; and control means for temporarily stopping the aforementioned discharge means when the aforementioned position detection means detects the upper most surface of the sheets stored on the aforementioned storage means or the surface of the aforementioned storage means for stacking the sheets to be away from a predetermined position and the aforementioned reception means detects the sheet is being transported in the aforementioned image forming apparatus, after the sheet being transported is discharged to the aforementioned storage means by the aforementioned discharge means.

In the sheet discharge apparatus according to the present invention, the control means controls the aforementioned elevator means to move the aforementioned storage means back to the aforementioned predetermined position while the aforementioned discharge means is temporarily stopped discharging the sheets.

Also, according to the sheet discharge apparatus of the present invention, the aforementioned control means starts a drive of the aforementioned elevator means during a period of time between when the aforementioned reception means detects the sheet being transported exists in the aforementioned image forming apparatus and when the aforementioned discharge means discharges the sheet to the aforementioned storage means, and controls the aforementioned elevator means to move the aforementioned storage means to a predetermined position.

The sheet discharge apparatus according to the present invention may be further equipped with sheet size reception means for receiving a signal from the aforementioned image forming apparatus indicating a size of the sheet being transported in the aforementioned image forming apparatus, and the aforementioned control means controls a timing to start the aforementioned elevator means according to the size of the sheet received by the aforementioned sheet size reception means.

The control means in the sheet discharge apparatus according to the present invention controls the aforementioned elevator means to start the drive earlier as the size of the sheets received by the aforementioned sheet size reception means becomes smaller.

The sheet discharge apparatus according to the present invention may be further equipped with sheet length reception means for receiving a signal from the aforementioned image forming apparatus indicating the length of the sheets being transported in a transport direction in the aforementioned image forming apparatus, and the aforementioned control means controls a timing to start the aforementioned elevator means according to the length of the sheet in the transport direction received by the aforementioned sheet length reception means.

The control means in the sheet discharge apparatus according to the present invention controls the aforementioned elevator means to start a drive thereof earlier as the length of the sheets in the transport direction received by the aforementioned sheet length reception means becomes shorter.

The sheet discharge apparatus according to the present invention may be further equipped with sheet size reception means for receiving a signal from the aforementioned image forming apparatus indicating the size of the sheet being transported in the aforementioned image forming apparatus, and the aforementioned control means controls the aforementioned elevator means to change an elevating speed of the aforementioned storage means according to the size of the sheet received by the aforementioned sheet size reception means.

The control means in the sheet discharge apparatus according to the present invention controls the aforementioned storage means to increase a rising and lowering speed of the aforementioned elevator means as the size of the sheets received by the aforementioned sheet size reception means becomes smaller.

The sheet discharge apparatus according to the present invention may be further equipped with sheet length reception means for receiving a signal from the aforementioned image forming apparatus indicating the length of the sheet being transported in the transport direction in the aforementioned image forming apparatus, and the aforementioned control means controls the aforementioned elevator means to change a rising and lowering speed of the aforementioned storage means according to the length of the sheet in the transport direction received by the aforementioned sheet length reception means.

The control means in the sheet discharge apparatus according to the present invention controls the aforementioned elevator means to increase the elevating speed of the aforementioned storage means earlier as the length of the sheets in the transport direction received by the aforementioned sheet length reception means becomes shorter.

The sheet discharge apparatus according to the present invention may be further equipped with support means for supporting the sheets discharged by the aforementioned discharge means, and further equipped with finishing means for finishing the sheets while straddling between the aforementioned support means and the aforementioned storage means.

The sheet discharge apparatus according to the present invention performs alignment, binding or opening hole on the sheets as the aforementioned finishing means.

An image forming apparatus according to the present invention comprises stacking means for stacking the sheets; sheet supply means for supply the sheets from the aforementioned stacking means one sheet at a time; image forming means for forming an image onto the sheet supplied from the aforementioned sheet supply means; storage means for storing the sheets with the image formed thereon by the aforementioned image forming means; a transport path for guiding the sheet from the aforementioned image forming means to the aforementioned storage means; transport means for transporting the sheet along the aforementioned transport path and storing the sheet in the aforementioned storage means; sheet presence detecting means for detecting a presence of the sheet in the aforementioned transport path; elevator means for raising and lowering the aforementioned storage means relative to a downstream end of the aforementioned transport means in the sheet transport direction, position detection means for detecting the uppermost surface of the sheets stored in the aforementioned storage means or a surface of the aforementioned storage means for stacking the sheets; and control means for temporarily stopping the aforementioned sheet supply means when the aforementioned position detection means detects that the uppermost surface of the sheets stored in the aforementioned storage means or the surface of the aforementioned storage means for stacking the sheets are away from a predetermined position and the aforementioned sheet presence detection means detects the sheet in the aforementioned transport path, after the aforementioned sheet being transported is stored in the aforementioned storage means.

According to the present invention, a sheet discharge apparatus is equipped with discharge means for discharging sheets from an image forming apparatus; storage means for storing the sheets discharged from the aforementioned discharge means; elevator means for raising and lowering the aforementioned storage means relative to the aforementioned discharge means; position detection means for detecting a surface of the upper most sheet stored in the aforementioned storage means or a surface of the aforementioned storage means on which the sheet is to be stacked; and control means for temporarily stopping the aforementioned discharge means when the aforementioned position detection means detects the upper most surface of the sheets stored on the aforementioned storage means or the surface of the aforementioned storage means for stacking the sheets to be away from a predetermined position and the aforementioned reception means detects the sheet is being transported in the aforementioned image forming apparatus, after the sheet being transported is discharged to the aforementioned storage means by the aforementioned discharge means.

The sheet discharge apparatus according to the present invention may be further equipped with sheet size reception means for receiving a signal from the aforementioned image forming apparatus indicating a size of the sheet, and the aforementioned control means controls a timing to start the aforementioned elevator means according to the size of the sheet received by the aforementioned sheet size reception means.

The control means in the sheet discharge apparatus according to the present invention controls the aforementioned elevator means to start the drive earlier as the size of the sheets received by the aforementioned sheet size reception means becomes smaller.

The sheet discharge apparatus according to the present invention may be further equipped with sheet length reception means for receiving a signal from the aforementioned image forming apparatus indicating the length of the sheets in a transport direction, and the aforementioned control means controls a timing to start the aforementioned elevator means according to the length of the sheet in the transport direction received by the aforementioned sheet length reception means.

The control means in the sheet discharge apparatus according to the present invention controls the aforementioned elevator means to start a drive thereof earlier as the length of the sheets in the transport direction received by the aforementioned sheet length reception means becomes shorter.

The sheet discharge apparatus according to the present invention may be further equipped with sheet size reception means for receiving a signal from the aforementioned image forming apparatus indicating the size of the sheet, and the aforementioned control means controls the aforementioned elevator means to change an elevating speed of the aforementioned storage means according to the size of the sheet received by the aforementioned sheet size reception means.

The control means in the sheet discharge apparatus according to the present invention controls the aforementioned storage means to increase a rising and lowering speed of the aforementioned elevator means as the size of the sheets received by the aforementioned sheet size reception means becomes smaller.

The sheet discharge apparatus according to the present invention may be further equipped with sheet length reception means for receiving a signal from the aforementioned image forming apparatus indicating the length of the sheet in the transport direction, and the aforementioned control means controls the aforementioned elevator means to change a rising and lowering speed of the aforementioned storage means according to the length of the sheet in the transport direction received by the aforementioned sheet length reception means.

The control means in the sheet discharge apparatus according to the present invention controls the aforementioned elevator means to increase the elevating speed of the aforementioned storage means earlier as the length of the sheets in the transport direction received by the aforementioned sheet length reception means becomes shorter.

The structures of the present invention described above effectively eliminate a sheet jam and a folded sheet in the image forming apparatus or the sheet discharge apparatus (the sheet finishing apparatus) to improve the alignment of the discharged sheets and the discharging performance.

BRIEF DESCRIPTION OF THE DRAWINGS

FIG. 9 is a flowchart representing a processing procedure in the third embodiment;

DETAILED DESCRIPTION OF THE PREFERRED EMBODIMENT

Hereunder, embodiments of a program together with a sheet discharge control method, a sheet discharge apparatus and an image forming apparatus according to the present invention in reference to the accompanied drawings.

Figure 1:
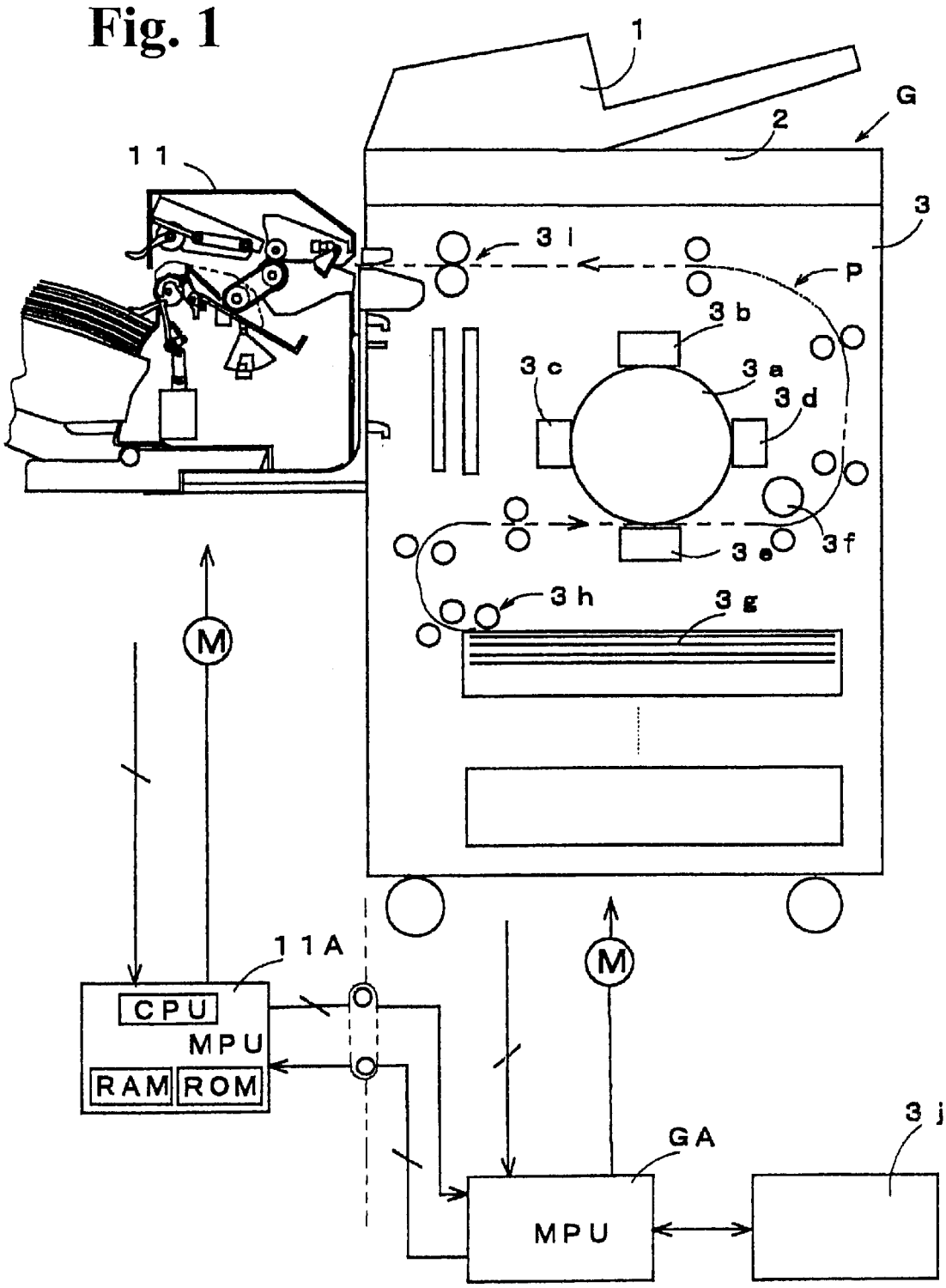
FIG. 1 is a view showing an entire configuration of an embodiment of the present invention.

FIG. 1 is a view showing an entire configuration of the embodiment of the present invention.

In FIG. 1, the general configuration of the example of the sheet discharge apparatus includes an image forming apparatus G, such as a copier or a printer, and a finisher apparatus 11. The finisher apparatus 11 is detachably mounted to the image forming apparatus G (a combination of the image forming apparatus G and the finisher apparatus 11 corresponds to the image forming apparatus).

The image forming apparatus G shown in FIG. 1 shows an essential structure of a conventional copier or printer and is equipped with a scanner 2 below an automatic document feeder (or ADF) 1. An image generation portion (printer engine) 3 is arranged below the scanner 2.

In the image generation portion 3, an electrostatic body 3*b*, a developer 3*c*, a cleaner 3*d* and a transfer device 3*e* are arranged on a circumference of a photoconductor body 3*a*. Also, a plurality of rollers (from a pick-up roller 3*h* to a discharge roller 3*i*) is established along a transport path P to accommodate a sheet S (paper) according to a size thereof and a control of a series of printing processes from charging at the photoconductor 3*a* to removal of toner. A paper cassette (3*g*) for stacking and storing the sheets with various sizes is arranged below them.

Figure 2:
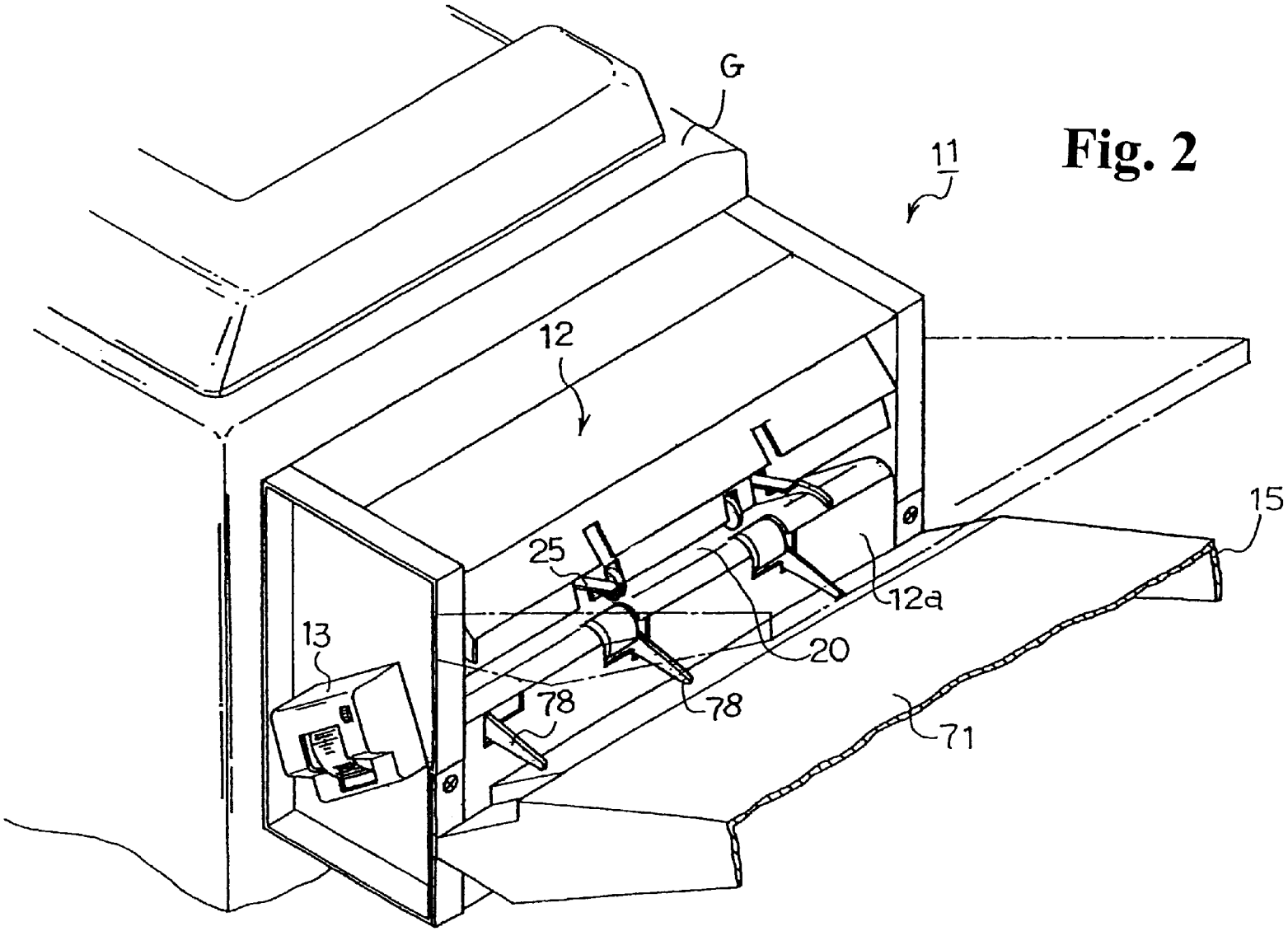
FIG. 2 is a perspective view showing an essential external configuration of a finisher apparatus shown in FIG. 1.
Figure 3:
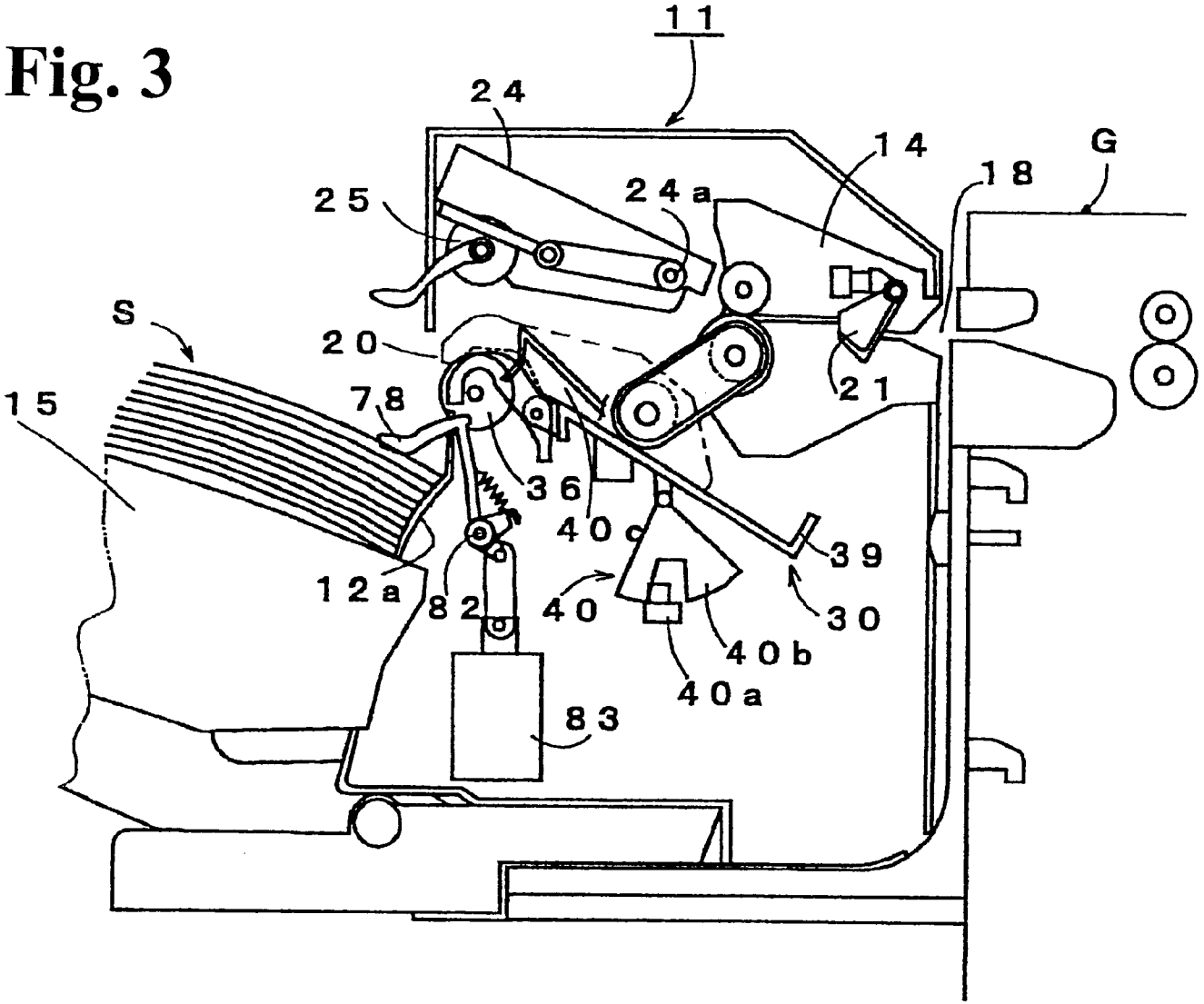
FIG. 3 is a side view showing the essential external configuration of the finisher apparatus shown in FIG. 1.

The following describes a configuration of the finisher apparatus 11 in detail according to FIG. 2 and FIG. 3.

In the image forming apparatus G and finisher apparatus 11 of the embodiment, a microprocessor unit (MPU) GA in the image forming apparatus G performs control of a series of the known various printing processes from charging to removal of toner and drive of motors, and executes a variety of display and input processes on the touch panel 3*j* relating to printing.

Also, in the finisher 11, a microprocessor unit (MPU) 11A controls a variety of processes according to 'a straight operation mode' and 'a shift operation mode', described in detail below, and motor drive to process the sheets discharged from the image forming apparatus G.

Also, the microprocessors GA and 11A are working together to execute control according to the present invention described in detail below. In this process, a status signal is sent from the image forming apparatus G to the finisher apparatus 11, and a control command is sent from the finisher apparatus 11 to the image forming apparatus G.

Note that in the example in FIG. 1, the two separate microprocessors GA and 11A are arranged. However, the microprocessor GA in the image forming apparatus G may execute the control of the finisher apparatus 11 (for example, time division multiplex control).

The following will describe the finisher apparatus 11 in detail.

FIG. 2 is a perspective view showing an external configuration of the essential portions of the finisher apparatus 11, and FIG. 3 is a side view showing the internal configuration of the essential portions of the finisher apparatus 11.

According to FIG. 1 to FIG. 3, the finisher apparatus 11 is provided with a main apparatus 12, a staple unit 13 mounted to one side frame of the main apparatus 12, and a drive transmission mechanism, not shown in the drawings, arranged on the other side frame of the main apparatus 12. Furthermore, the finisher apparatus 11 is provided with an inlet 18, to which the sheets with the images formed thereon discharged from the image forming apparatus G are supplied, a discharge outlet 20 formed on a side opposite to the inlet 18 and a stacking tray 15 for stacking the sheet S discharged from the discharge outlet 20.

Note that the staple unit 13 may be a device for binding a bundle of the sheets S with staples, or may be provided with a punching unit for punching holes.

The main apparatus 12 comprises the first transport path for guiding the sheet S from the inlet 18 into the main apparatus 12, the second transport path for discharging the sheet S to the stacking tray 15 through the discharge outlet 20, and the third transport path having a step relative to the second transport path for guiding the sheet S in the processing tray 39 for temporary storage after switching back a transport direction of the sheet. At the processing tray 39, an adjacent edge of each of the sheet S is aligned by, for example, a pressing drive member (not shown in the drawings) having an alignment plate, then the aforementioned staple unit 13 stables the sheet bundle or the punching unit, not shown in the drawings, punches the holes.

The following will describe only the case of binding the sheet bundles.

Note that the finisher apparatus 11 has the following operation modes to transport the sheet S using the first to third transport paths.

(1) Straight operation mode

The sheet S is discharged directly to the stacking tray 15 through the first transport path and the second transport path.

(2) Shift Operation Mode (the stapling operation)

The sheet S transported from the first transport path to the second transport path is switch-backed along the second transport path and the third transport path, and while a plurality of the sheet S is stacked and placed on the processing tray 39, the edges thereof are aligned. Then, the staple unit 13 binds the aligned sheet S bundle at a predetermined position, and the sheet S bundle is discharged to the stacking tray 15.

The first transport path comprises an inlet sensor 21 and an endless transport belt 28 that transports the sheet S to the second transport path. Below the endless transport belt 28 is disposed a processing tray unit 30. The processing tray unit 30 temporarily stacks and places the sheet S so that the endless transport belt 28 rotates to sequentially take up the sheet S to be bound in a predetermined number of the sheets by the staple unit 3.

Above the second transport path is disposed a rotating unit 24 that rotates upward and downward around a paddle drive roller shaft 24*a* as a pivot.

In the rotating unit 24, a follower discharge roller (a bundle discharge roller) 25 is disposed. When the sheet S is discharged directly to the stacking tray 15 from the first transport path through the second transport path in the straight operation mode, or the sheet S bundle is discharged to the stacking tray 15 in the processing tray unit 30 in the shift operation mode, the rotating unit 24 moves downward to a position where the rotating unit can grip the sheet S or the sheet S bundle between the follower discharge roller 25 and the discharge roller 36 to discharge the sheet S or the sheet S bundle to the stacking tray 15 from the discharge outlet 20. When the sheet S is guided to the third transport path leading to the processing tray unit 30, the rotating unit 24 moves upward, as shown in FIG. 3, so that the rotating unit does not interfere with the sheet S being transported and switched back.

A sheet abutting member 12*a* is integrated with a front surface frame of the main apparatus 12 under the discharge roller 36 for regulating the edges of the sheet S stacked in the stacking tray 15. A sheet holder lever 78 is established on the sheet abutting member 12*a* near the discharge roller 36, and is able to protrude toward the second transport path through a disposed opening from an upper portion of the sheet abutting member 12*a*.

A holding lever solenoid 83 disposed on a backside of the sheet abutting member 12*a* drives the sheet holder lever 78 to protrude toward the stacking tray 15 from the sheet abutting member 12*a* every time when the discharge roller 36 and the follower discharge roller 25 discharge the sheet S or the sheet S bundle.

Figure 11:
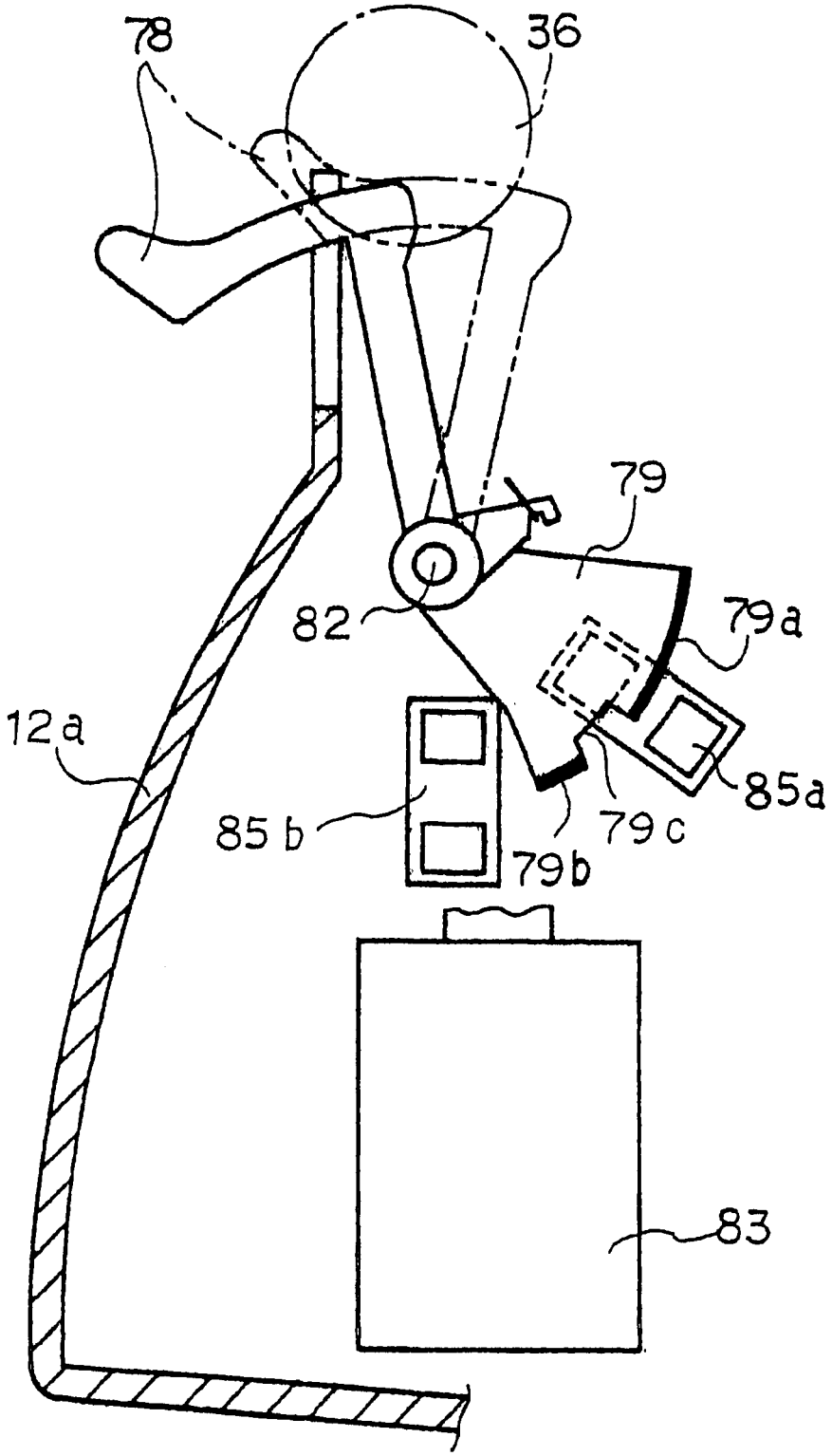
FIG. 11 is a view showing a mechanism for detecting a position of the stacking tray 15.

As shown in FIG. 11, the sheet holder lever 78 rotates around the rotating shaft 82 as a pivot. While the sheet holder lever 78 is pressing the sheet S, sheet stacking amount detection sensors 85*a* and 85*b* detect the first flag 79*a* and the second flag 79*b* of a detection flag 79 disposed on an edge of the sheet holder lever to determine a position of the uppermost surface of the sheets stacked on the stacking tray 15. Based on the signal, an elevator drive motor M (not shown in the drawings) for the stacking tray 15 is controlled to rotate in forward or reverse, thereby accurately maintaining a level of the uppermost surface of the sheets stacked on the stacking tray 15.

Note that a notch portion 79*c* is provided between the first flag 79*a* and the second flag 79*b* of the detection flag 79, and does not react to the sheet stacking amount detection sensors 85*a* and 85*b*.

A sensor 40 is established under the processing tray 39. The sensor 40 is composed of a sensor lever 40*c* extending into the second transport path at a side of the discharge outlet 20, a sensor flag 40*b* rotatably supported by the sensor rotation shaft under the processing tray 39, and a sheet presence sensor 40*a* for detecting the sensor flag 40*b*.

The sensor lever 40*c* extends into the second transport path when no sheet S is present therein.

This sensor 40 is able to detect the presence of the sheet S in the second transport path and the presence of the sheet S on a sheet stacking portion of the processing tray 39.

That is, the sensor 40 functions as a transport pass-through sensor for detecting the sheet S whose a trailing edge is discharged, when there is no sheet stacked in the stacking portion and the sheets are stacked on the stacking tray 15 one by one after passing through the first transport path and the second transport path. Also, the sensor 40 is able to detect the sheets as a discharged sheet S bundle passing sensor when a bundle of the sheets is discharged from the processing tray 39.

Also, a passing detection signal from the sensor 40 is used as a signal for activating the holding lever solenoid 83 to move the sheet holder lever 78.

Next, the stacking tray 15 will be explained.

Figure 4:
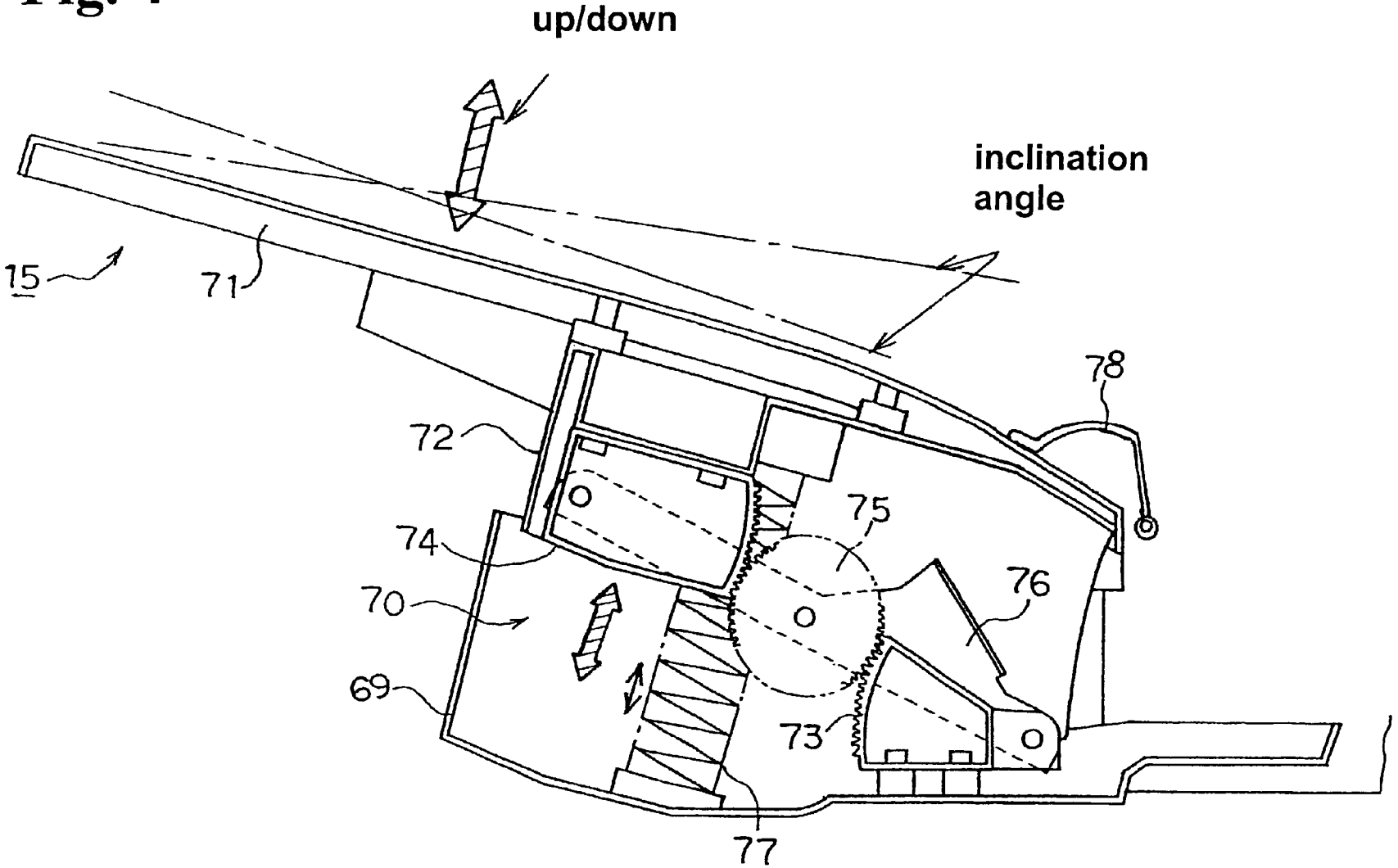
FIG. 4 is a side view showing a configuration of a stacking tray in FIG. 1.

FIG. 4 is a side view showing a configuration of the stacking tray 15.

In the stacking tray 15 shown in FIG. 4, a base 69 having a mounting portion detachable to the main apparatus 12 shown in FIG. 1 and in FIG. 2, a sheet storage portion 71 held to the base 69 via the elevator control portion 70 and being able to move up and down, and a support bracket 72 fixed to a bottom of the sheet storage portion 71 are mounted on an upper surface of the movable gear 74.

The elevator control portion 70 is equipped with an arc-shaped fixed gear 73 fixed to the base 69; an arc-shaped movable gear 74 fixed to the support bracket 72; a planetary gear 75 moving through an engagement with the gears 73 and 74; a shift arm 76 connecting the gears 73 and 74 and the planetary gear 75 for maintaining their relative distances; a coil spring 77 disposed between an upper surface of the base 69 and a bottom of the support shaft 72 for constantly urging the sheet storage portion 71 upward.

The coil spring 77 has an elasticity constant being set to change a position of the sheet storage portion 71 downward according to the weight of the sheet S stacked sequentially on the upper surface of the sheet storage portion 71, so that the top surface of the stacked sheets S remains substantially a constant height as the next sheet is sequentially stacked on the previous sheet. Also, when the sheet storage portion 71 as a surface for supporting the sheets S moves downward against the elasticity of the coil spring, an upper surface of the sheet storage portion 71, which is mounted on an upper surface of the movable gear 74 via the support bracket 72, moves in substantially parallel from an upper position in the figure to a lower limit position of an arrow according to a displacement of the meshing positions of the planetary gear 75 and the gears 73, 74 as an amount of the stacked sheets S is increased.

A motor M, not shown in the drawings, is established to the planetary gear 75, and the microprocessor 11A in FIG. 1 controls to adjust a height of the stacking tray 15 when the sheet S is removed, explained below.

The following will describe the embodiment according to the present invention.

Here, there are four embodiments (1), (2), (3), (4) for adjusting the height of the stacking tray 15 when removing the sheet S.

(1) First embodiment

When the sheet S is removed from the stacking tray 15, the stacking tray 15 is raised to a home position (HP) more quickly than normal, thereby shortening a recovery time to the home position.

(2) Second embodiment

When the sheet S is removed from the stacking tray 15, after the sheet S is discharged from the image forming apparatus G, the height of the stacking tray 15 is raised to the home position, thereby improving the alignment and the discharging performance of the sheet S, and also eliminating a sheet jam and a folded sheet in the sheet finishing apparatus.

(3) Third embodiment

When the sheet S is removed from the stacking tray 15, the height of the stacking tray 15 is raised according to the size of the sheet S, thereby improving the alignment and the discharging performance of the sheet S. This prevents the sheet S with a smaller size from curling and being inverted front to back when the sheet drops into the stacking tray 15 from the discharge outlet 20.

(4) Fourth embodiment

When the sheet S is removed from the stacking tray 15, the speed to raise the stacking tray 15 is changed according to the size of the sheet S, thereby improving the alignment and the discharging performance of the sheet S. Similarly in this case, this prevents the sheet S with a smaller size from curling and being inverted front to back when the sheet drops into the stacking tray 15 from the discharge outlet 20.

Figure 5:
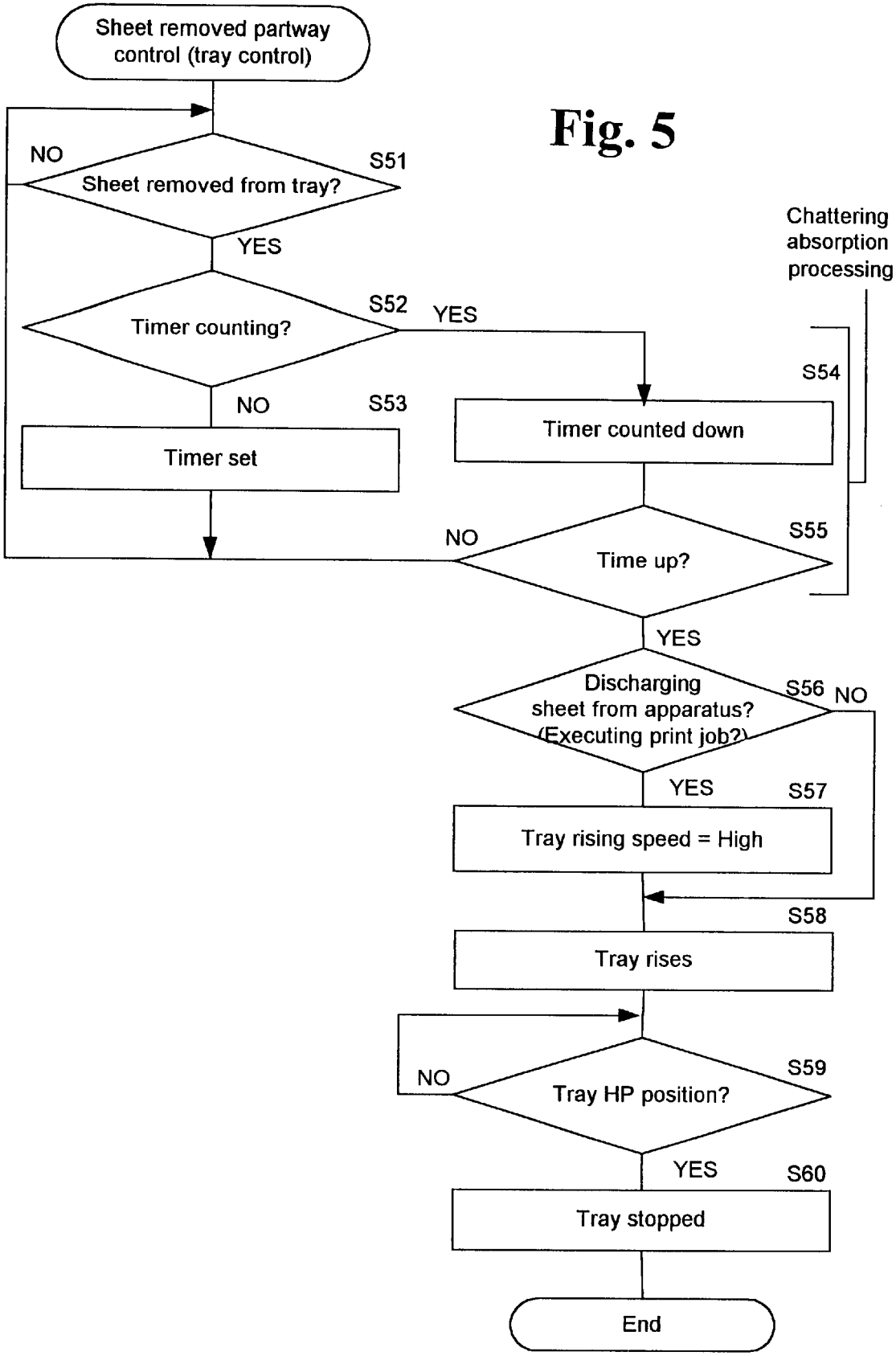
FIG. 5 is a flowchart representing a processing procedure in the first embodiment.
Figure 6:
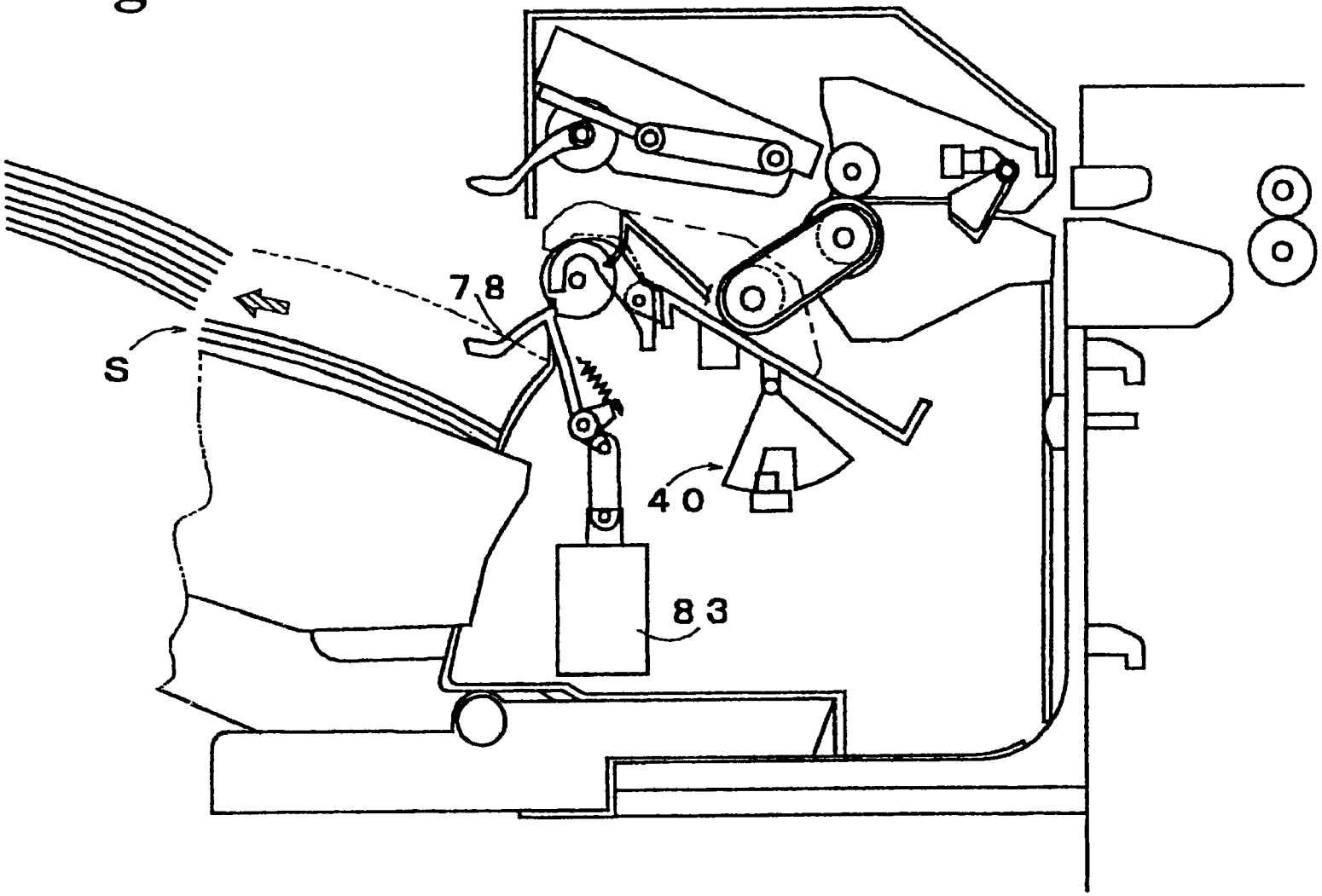
FIG. 6 is a view showing a state that a sheet is removed from a stacking tray according to the first embodiment of the present invention.

FIG. 5 is a flowchart representing a processing procedure of the second embodiment. FIG. 6 is a view showing a state that the sheet S is removed from the stacking tray 15, and FIG. 7 a view explaining a rising control of the stacking tray 15.

From FIG. 1 to FIG. 5, it is determined whether the sheet S has been removed from the stacking tray 15 as shown in FIG. 6. If it is the case, the microprocessor 11A on the finisher apparatus 11, as shown in FIG. 1, is interrupted according to the detection signal from the sheet stacking amount detection sensors 85. The microprocessor 11A receives in the detection signal from the sheet stacking amount detection sensors 85, thereby recognizing that the height of the sheet S is lowered (step S51). Next, a chattering absorption processing is performed. This is a process for obtaining a stable converged detection signal for the rising control of the stacking tray 15, since the detection signal from the sheet stacking amount detection sensors 85 is varied (chattering) by the removal of the sheet S.

In the chattering absorption processing, the microprocessor 11A determines whether a built-in counter is counting (step S52) after step S51. If it is not the case (No), the timer is set (step S53) and it returns to step S51. If it is the case (Yes) at step S52, a counting (timer) value is subtracted (step S54) Then, it is determined that the time is up (step S55) in which a predetermined counting value (a chattering convergence time) has been reached.

If it is not the case at step S55, it returns to step S51 and repeats the subsequent routine. At step S55, if it is the case (Yes), it is determined whether the image forming apparatus G is executing a job, in other words, the sheet S is being discharged (being transported using the rollers 3*h* to 3*i* in the image forming apparatus), by a sensor not shown in the drawings. Here, when it is discharging the sheet (Yes), the microprocessor 11A sends a signal to the microprocessor GA in the image forming apparatus G, so that a sheet in a unfed state in the paper cassette 3*g* will not be fed by the pick-up roller 3*h* in the image forming apparatus G, while setting a rising speed of the stacking tray 15 high (step S57).

A reason why the stacking tray 15 is raised at such a high speed is because different from a normal state, in which it is possible to take a long time to recover the stacking tray 15 to the home position as the next sheet S will not be discharged, the stacking tray 15 needs to move to the home position in time before the next sheet is discharged.

Note that at step S56, if it is not discharging the sheets (No), it is possible to raise the stacking tray 15 with a plenty of time because the next sheets will not be discharged. Therefore, step S57 is not executed (the raising speed of the stacking tray 15 is not set high). Then, the microprocessor 11A in the finisher apparatus 11 drives the motor M, not shown in the drawings, to rotate the planetary gear 75 shown in FIG. 4, to raise the stacking tray 15 to the predetermined position, namely the home position, illustrated in FIG. 7 (step S58). Next, it is determined if the stacking tray 15 has risen to the home position (step S59). The microprocessor 11A determines this by determining whether a value of the detection signal from the sheet stacking amount detection sensors 85 reaches a predetermined value of the home position. Then, the rising of the stacking tray 15 is stopped (step S60).

At step S60, after the stacking tray 15 stops at the home position, only the sheets S being discharged (being transferred by each of the rollers 3*h* to 3*i* in the image forming apparatus) are completely discharged from the rollers 3*h* to 3*i* to the stacking tray 15 through nipping of the follower discharge roller 25 and the discharge roller 36. The follower discharge roller 25 and the discharge roller 36 temporarily stop after all the sheets S being discharged is completely discharged to the stacking tray 15.

Each of the rollers including the discharge roller 3*i* as the transport means in the image forming apparatus temporarily stops after all the sheets S being discharged (being transferred by each of the rollers 3*h* to 3*i* in the image forming apparatus) is completely discharged to the finisher apparatus 11, and the pickup roller 3*h* as the sheet supply means temporarily stops at step S56, after the sheets being fed are supplied and it is determined that the discharging of the sheets S is being processed (transferred by each of the rollers 3*h* to 3*i* in the image forming apparatus).

Figure 8:
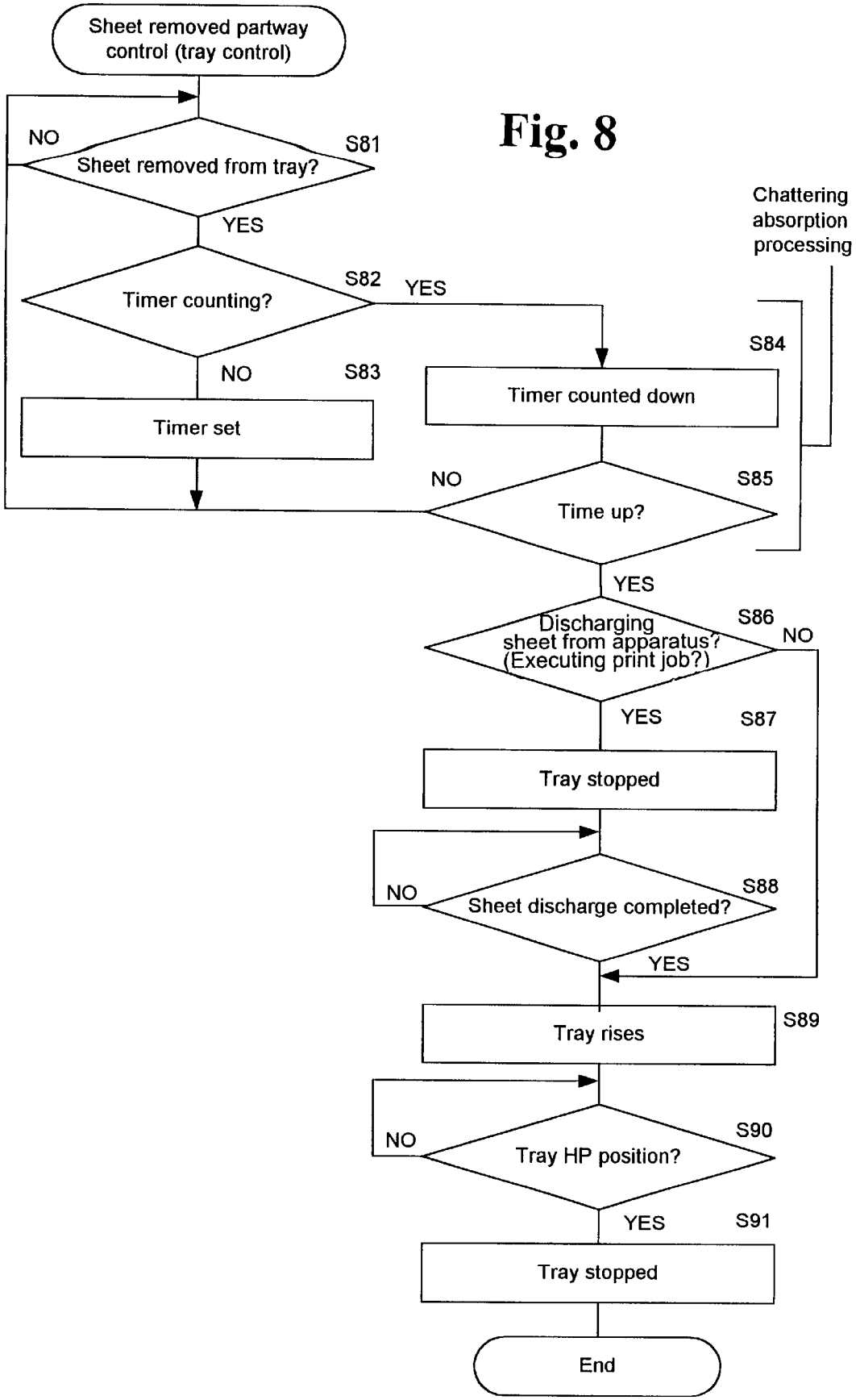
FIG. 8 is a flowchart representing a processing procedure in the second embodiment.

FIG. 8 is a flowchart representing a processing procedure in the second embodiment.

From FIG. 1 to FIG. 4 and FIG. 8, in the same manner as described in the first embodiment, the microprocessor 11A recognizes that the sheets S is removed from the stacking tray 15, as shown in FIG. 6, by receiving a detection signal, thereby recognizing that the height of the sheets S is lowered (step S81). Next, the chattering absorption processing is performed until the variances (chattering) in the sheet holder lever 78 caused by the removal of the sheets S is converged (steps S82 to S85, see the explanation of steps S52 to S55 in the first embodiment).

Next, at step S85, if the time is up (Yes), it is determined whether the image forming apparatus G is executing the job, in other words the sheet S is being discharged (transported using the rollers 3*h* to 3*i* in the image forming apparatus) by a sensor, not shown in the drawings (step S86). Here, when it is discharging the sheet (Yes), the microprocessor 11A sends a signal to the microprocessor GA in the image forming apparatus G so that an unfed sheet in the paper cassette 3*g* is not fed by the pick up roller 3*h* in the image forming apparatus G, and controls to stop the stacking tray 15 (step S87). Next, it is determined if the job is completed, in other words the discharge of the sheets S is completed (the sheets S being transported in the image forming apparatus are discharged to the stacking tray 15) (step S88). If the discharging is completed at this point (Yes), and there is no execution of the job at step S86 (No), it proceeds to the next processing of step S89.

Figure 7:
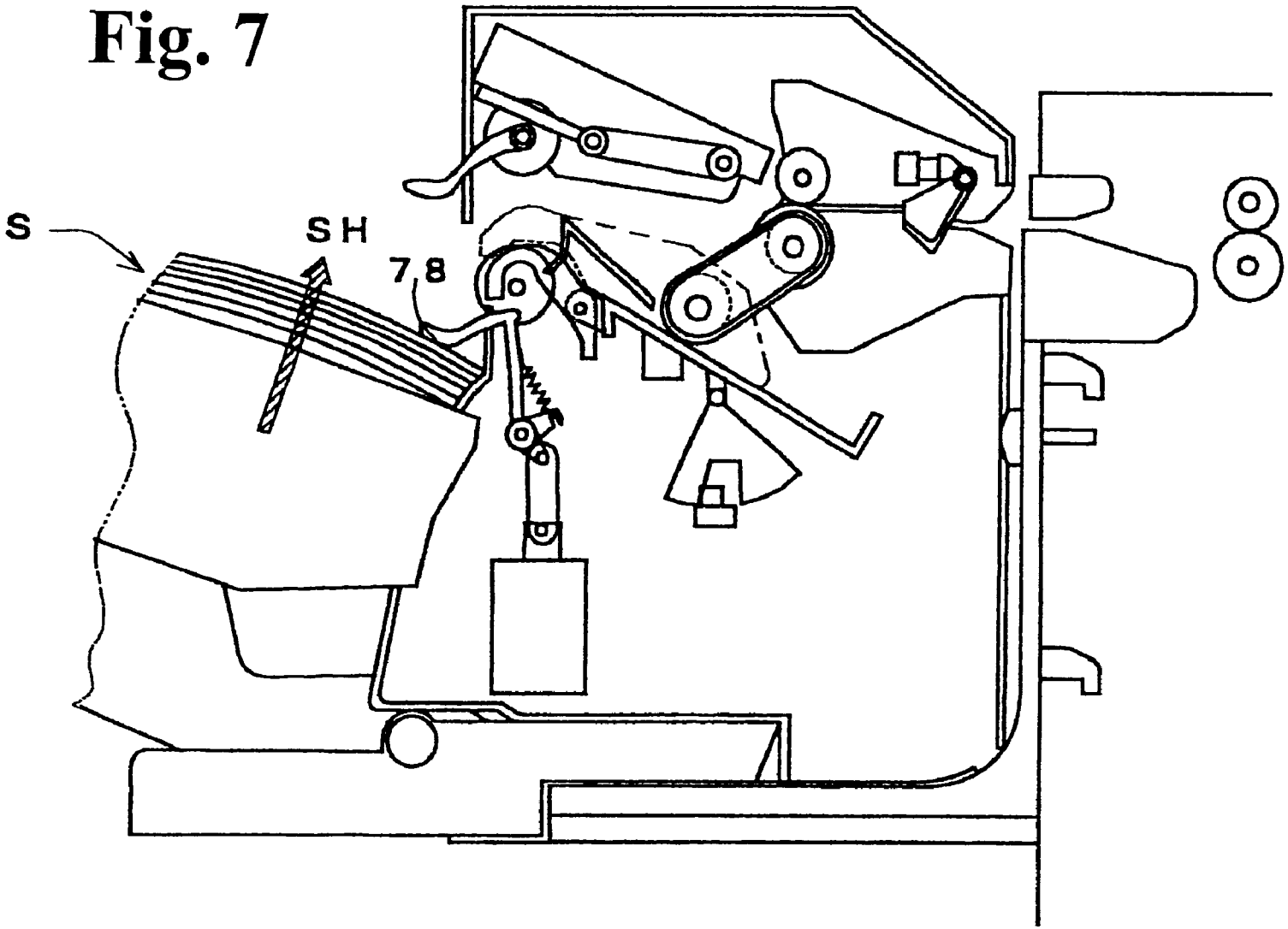
FIG. 7 is a view explaining a control of raising the stacking tray according to the first embodiment of the present invention.

Then, the microprocessor 11A in the finisher apparatus 11 drives the motor M, not shown in the drawings, to rotate the planetary gear 75 shown in FIG. 4, thereby raising the stacking tray 15 to the predetermined home position, as shown in FIG. 7 (step S89).

There, it is determined that the job is completed at step S88. Therefore, there is a plenty of time to raise the stacking tray 15 because a subsequent sheet will not be discharged, and there is no need to set the rising speed of the stacking tray 15 high, as in step S57 of FIG. 5. Next, it is determined if the stacking tray 15 is risen to the home position (step S90). The microprocessor 11A determines this by determining whether a value of the detection signal from the sheet stacking amount detection sensors 85 reaches the predetermined value of the home position. Then, the rising of the stacking tray 15 is stopped (step S91).

Thus the sheets being discharged (being transported in the image forming apparatus) are discharged to the stacking tray 15.

FIG. 9 is a flowchart representing a processing procedure in the third embodiment.

From FIG. 1 to FIG. 4 and FIG. 9, in the same manner as described in the first embodiment, the microprocessor 11A recognizes that the sheets S is removed from the stacking tray 15, as shown in FIG. 6, by receiving the detection signal from the sheet stacking amount detection sensors 85, thereby recognizing that the height of the sheets S is lowered (step S101). Next, the chattering absorption processing is performed until the variance in the sheet holder lever 78 caused by the removal of the sheets S is converged (steps S102 to S105, see the explanation for steps S52 to S55 in the first embodiment).

Next, at step S105, if the time is up (Yes), the image forming apparatus G determines whether the job is being executed, in other words, that the sheet S is being discharged (transported using the rollers 3*h* to 3*i* in the image forming apparatus) by a sensor not shown in the drawings (step S106).

Note that at step S106, if no sheet is being discharged (No), it is possible to raise the stacking tray 15 with a plenty of time because the next sheet will not be discharged. Therefore, step S111 is not executed (the raising speed of the stacking tray 15 is not set high).

Here, when the sheet is being discharged (Yes), the microprocessor 11A sends a signal to the microprocessor GA in the image forming apparatus G not to feed the unfed sheet in the paper cassette 3*g* using the pick-up roller 3*h* in the image forming apparatus G and verifies the size of the sheet being discharged. To perform the verification, the microprocessor 11A in the finisher apparatus 11 verifies through a status signal from the microprocessor GA in the image forming apparatus G, or the finisher apparatus 11 verifies through a period of time for the sheet to pass from the inlet sensor 21 (step S107) when the finisher apparatus 11 receives the transport of the sheet S from the image forming apparatus G from the inlet 18 shown in FIG. 3.

A counting value (timer) corresponding to the size of the sheet S is set according to the verification, and subsequently the subtraction is performed (steps S108 and S109). The timer is set to be shorter as the sheet S has a shorter length in the transport direction. In other words, the startup timing of the sheet storage portion 71 on the stacking tray 15 is made earlier to move more quickly to the appropriate position. Through this, when the sheet S with a smaller size or a shorter length in the transport direction is discharged from the processing tray 39 to the sheet storage portion 71 of the stacking tray 15, the sheet storage portion 71 of the stacking tray 15 rises to the appropriate position, for example the home position, at an earlier timing, thereby preventing the sheet S with a smaller size or a shorter length in the transport direction from being stored with upside down. Then, it is determined if the time is up (step S110), namely if the count reaches the predetermined counting (timer) value. If the time is not up at step S104, it returns to step S103 and repeats the subsequent routine. If the time is up (Yes) at step S104, the raising speed of the stacking tray 15 is set high (step S111), as shown in the aforementioned step S57. Then, the microprocessor 11A in the finisher apparatus 11 drives the motor M, not shown in the drawings, to rotate the planetary gear 75 shown in FIG. 4 to raise the stacking tray 15 to the determined home position, illustrated in FIG. 7 (step S112). Next, it is determined if the stacking tray 15 is risen to the home position (step S113). The microprocessor 11A determines this by determining whether a value of the detection signal from the sheet stacking amount detection sensors 85 reaches the predetermined value of the home position. Then, the rising of the stacking tray 15 is stopped (step S114).

Thus, the sheet being discharged (being transported in the image forming apparatus) is discharged to the stacking tray 15.

Figure 10:
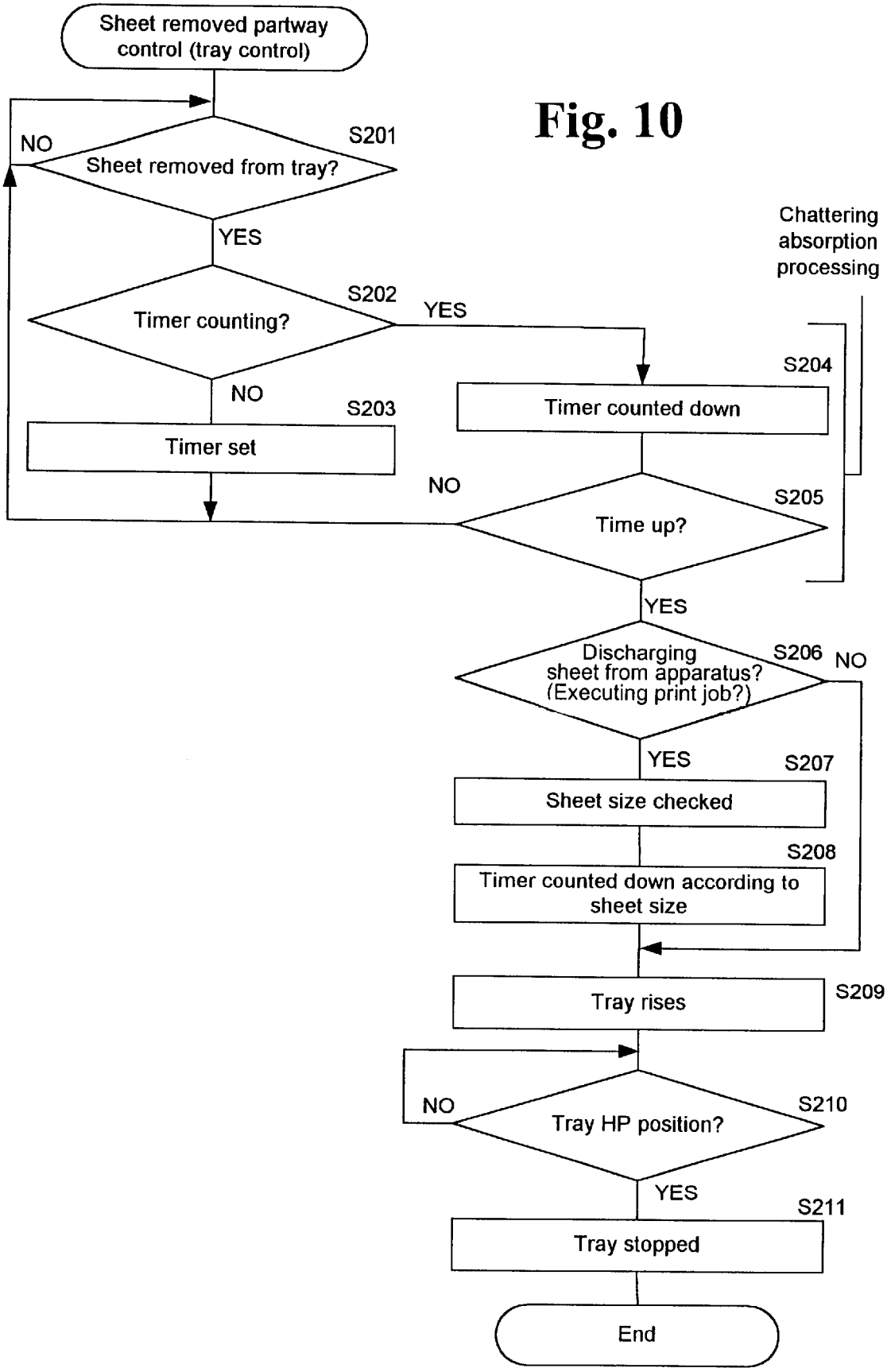
FIG. 10 is a flowchart representing a processing procedures in the fourth embodiment.

FIG. 10 is a flowchart representing a processing procedure in the fourth embodiment.

From FIG. 1 to FIG. 4 and FIG. 10, in the same manner as described in the first embodiment, the microprocessor 11A recognizes that the sheets S is removed from the stacking tray 15, as shown in FIG. 6, by receiving the detection signal from the sheet stacking amount detection sensors 85, thereby recognizing that the height of the sheets S is lowered (step S201). Next, the chattering absorption processing is performed until the variance in the sheet holder lever 78 caused by the removal of the sheets S is converged (steps S202 to S205, see the explanation in steps S52 to S55 in the first embodiment).

Next, at step S205, if the time is up (Yes), the image forming apparatus G determines whether the job is being executed, in other words, that the sheet S is being discharged (transported using the rollers 3*h* to 3*i* in the image forming apparatus) by a sensor not shown in the drawings (step S206).

Note that at step S206, if no sheet is being discharged (No), it is possible to raise the stacking tray 15 with a plenty of time because the next sheet will not be discharged. Therefore, step S208 is not executed (the raising speed of the stacking tray 15 is not set high).

Here, when the sheet is being discharged (Yes), the microprocessor 11A sends a signal to the microprocessor GA in the image forming apparatus G not to feed the unfed sheet in the paper cassette 3*g* using the pick-up roller 3*h* in the image forming apparatus G and verifies the size of the sheet being discharged (step S207). To perform the verification, the microprocessor 11A in the finisher apparatus 11 verifies through a status signal from the microprocessor GA in the image forming apparatus G, or the finisher apparatus 11 verifies through a period of time for the sheet to pass from the inlet sensor 21 when the finisher apparatus 11 receives the transport of the sheet S from the image forming apparatus G from the inlet 18 shown in FIG. 3.

As the next sheet will not be discharged, the raising speed of the stacking tray 15 is set higher than that in the normal state in which there is a plenty of time to raise to the home position (step S208). The speed is set to be higher as the sheet S has a shorter length in the transport direction as verified in step S207.

Through this, when the sheet S with a smaller size or a shorter length in the transport direction is discharged from the processing tray 39 to the sheet storage portion 71 of the stacking tray 15, the sheet storage portion 71 of the stacking tray 15 rises to the appropriate position, for example the home position, at an earlier timing, thereby preventing the sheet S with a smaller size or a shorter length in the transport direction from being stored with upside down due to a difference in levels between the processing tray 39 and the sheet storage portion 71 of the stacking tray 15.

After setting the raising speed, if there is no discharging being conducted at step S206, the tray is raised (step S209). The microprocessor 11A in the finisher apparatus 11 drives the motor M, not shown in the drawings, to rotate the planetary gear 75 shown in FIG. 4, to raise the stacking tray 15 to the home position as shown in FIG. 7.

Next, it is determined if the stacking tray 15 is raised to the home position (step S210). The microprocessor 11A determines this by determining whether a value of the detection signal from the sheet stacking amount detection sensors 85 reaches the predetermined value of the home position. Then, the raising of the stacking tray 15 is stopped (step S211). Thus, the sheet being discharged (transported in the image forming apparatus) is discharged to the stacking tray 15.

According to the descriptions of the first, third and fourth embodiments of the present invention, by controlling the startup timing and the raising speed of the stacking tray 15, all the sheets S being discharged (transported using the rollers 3*h* to 3*i* in the image forming apparatus) are discharged and are stored with good alignment while the stacking tray 15 is recovered to the home position. However, it is not necessarily to discharge all the sheets S while the stacking tray is recovered to the home position, and it is possible to control the startup timing and the raising speed of the stacking tray 15 so that some or all of the sheets S being discharged (transported using the rollers 3*h* to 3*i* in the image forming apparatus) are stored in the stacking tray 15 as the stacking tray 15 is recovering to the home position.

According to the explanation for the first to the fourth embodiments of the present invention, the stacking tray 15 is configured to raise and lower with regard to the follower discharge roller 25 and the discharge roller 36 as the sheet discharge means. However, it is also perfectly acceptable to raise and lower the sheet discharge means and transport means such as the follower discharge roller 25 and the discharge roller 36 with regard to the stacking tray 15.

In the explanations for the first to the fourth embodiment of the present invention, when the sheet S is removed from the stacking tray 15, only the sheet S being transported in the image forming apparatus G is discharged to the stacking tray. Controlling the rising and lowering of the stacking tray 15 is performed based on a premise that the subsequent sheet feeding and transporting operations performed by the image forming apparatus G and the sheet discharging operation by the finisher apparatus 11 as the sheet discharge apparatus are temporarily stopped. However, it is also perfectly acceptable to control the rising and lowering of the stacking tray 15 with a premise that the sheet feeding and transporting operations in the image forming apparatus G and the sheet discharging operation using the finisher apparatus 11 until the last sheet are continued, even after the sheets S is removed from the stacking tray 15.

According to the sheet discharge control method, the sheet discharge apparatus, the image forming apparatus and program according to this invention, it is possible to effectively eliminate the sheet jam and the folded sheet in the image forming apparatus or the sheet discharge apparatus, and to greatly improve the alignment of the discharged sheets and the discharging performance.

What is claimed is:

1. A sheet discharge apparatus comprising:

discharge means for discharging a sheet from an image forming apparatus;

storage means for storing the sheet discharged from the discharge means;

elevator means for raising and lowering the storage means relative to the discharge means;

position detection means for detecting an uppermost surface of the sheet stacked in the storage means or a surface of the storage means where the sheet is to be stacked;

reception means for receiving a signal from the image forming apparatus indicating a status of transporting the sheet in the image forming apparatus; and control means for temporarily stopping the discharge means after discharging the sheet to the storage means by said discharge means when the uppermost surface of the sheet discharged to the storage means or the surface of the storage means where the sheet is to be stacked is detected by the position detection means to be away from a predetermined position and the reception means detects that the sheet is being transported inside the image forming apparatus.

2. A sheet discharge apparatus according to claim 1, wherein said control means controls the elevator means to recover the storage means to the predetermined position while the discharge means temporarily stops to discharge the sheet.

3. A sheet discharge apparatus according to claim 1, wherein said control means controls the elevator means to recover to the predetermined position by starting operation of the elevating means from a time when the reception means detects the sheet while the sheet is being transported in the image forming apparatus to a time when the sheet is discharged to the storage means by the discharge means.

4. A sheet discharge apparatus according to claim 3, further comprising sheet size reception means for receiving a signal from the image forming apparatus, said signal indicating a size of the sheet that is transported inside the image forming apparatus, said control means controlling the elevator means to start at a different timing according to the size of the sheet determined by the signal received at the sheet size reception means.

5. A sheet discharge apparatus according to claim 4, wherein said control means controls the elevator means to start at an earlier timing as the size of the sheet determined by the signal received at the sheet size reception means becomes smaller.

6. A sheet discharge apparatus according to claim 3, further comprising sheet length reception means for receiving a signal from the image forming apparatus, said signal indicating a length of the sheet that is being transported in a transport direction inside the image forming apparatus, said control means controlling the elevator means to start at a different timing according to the length of the sheet in the transport direction determined by the signal received at the sheet length reception means.

7. A sheet discharge apparatus according to claim 6, wherein said control means controls the elevator means to start at an earlier timing as the length of the sheet in the transport direction determined by the signal received at the sheet length reception means becomes shorter.

8. A sheet discharge apparatus according to claim 3, further comprising sheet size reception means for receiving a signal from the image forming apparatus, said signal indicating a size of the sheet that is being transported inside the image forming apparatus, said control means controlling the elevator means to raise and lower the storage means at a different speed according to the size of the sheet determined by the signal received at the sheet size reception means.

9. A sheet discharge apparatus according to claim 8, wherein said control means controls the elevator means to raise and lower the storage means at a faster speed as the size of the sheet determined by the signal received at the sheet size reception means becomes smaller.

10. A sheet discharge apparatus according to claim 3, further comprising sheet length reception means for receiving a signal from the image forming apparatus, said signal indicating a length of the sheet in the transport direction that is being transported inside the image forming apparatus, said control means controlling the elevator means to raise and lower the storage means at a different speed according to the length of the sheet in the transport direction determined by the signal received at the sheet length reception means.

11. A sheet discharge apparatus according to claim 10, wherein said control means controls the elevator means to raise and lower the storage means at a higher speed as the length of the sheet in the transport direction determined by the signal received at the sheet length reception means becomes shorter.

12. A sheet discharge apparatus according to claim 1, further comprising support means for supporting the sheet discharged by the discharge means, and finishing means for performing a post-finishing on the sheet while the sheet straddles between the support means and the storage means.

13. A sheet discharge apparatus according to claim 1, wherein said finishing means performs an alignment of the sheet, binding of the sheet or opening a hole on the sheet.

14. An image forming apparatus comprising:

stacking means for stacking a sheet;

sheet supply means for supplying the sheet one at a time from the stacking means;

image forming means for forming an image on the sheet supplied from the sheet supply means;

storage means for storing the sheet with the image formed thereon by the image forming means;

a transport path for guiding the sheet from the image forming means to the storage means;

transport means for transporting the sheet along the transport path to be stored in the storage means;

sheet presence detection means for detecting presence of the sheet in the transport path;

elevator means for raising and lowering the storage means relative to a downstream edge of the transport means in a sheet transport direction;

position detection means for detecting an uppermost surface of the sheet stored in the storage means or a surface of the storage means where the sheet is to be stacked; and control means for temporarily stopping the supply means and stopping the transport means after storing the sheet being transferred to the storage means when the uppermost surface of the sheet discharged to the storage means or the surface of the storage means where the sheet is to be stacked is detected by the position detection means to be away from a predetermined position and the reception means detects the sheet that is being transported inside the image forming apparatus.

15. A sheet discharge apparatus comprising:

discharge means for discharging a sheet from an image forming apparatus;

storage means for storing the sheet discharged from the discharge means;

elevator means for raising and lowering the storage means relative to the discharge means;

position detection means for detecting an uppermost surface of the sheet stacked in the storage means or a surface of the storage means where the sheet is to be stacked; and control means for controlling the discharge means to continuously discharge the sheet until the last and controlling the elevator means to start to recover the storage means to the predetermined position when the uppermost surface of the sheet discharged to the storage means or the surface of the storage means where the sheet is to be stacked is detected by the position detection means to be away from a predetermined position.

16. A sheet discharge apparatus according to claim 15, further comprising sheet size reception means for receiving a signal from the image forming apparatus, said signal indicating a size of the sheet that is being transported inside the image forming apparatus, said control means controlling the elevator means to start at a different timing according to the size of the sheet determined by the signal received at the sheet size reception means.

17. A sheet discharge apparatus according to claim 16, wherein said control means controls the elevator means to start at an earlier timing as the size of the sheet determined by the signal received at the sheet size reception means becomes smaller.

18. A sheet discharge apparatus according to claim 15, further comprising sheet length reception means for receiving a signal from the image forming apparatus, said signal indicating a length of the sheet in a transport direction, said control means controlling the elevator means to start at a different timing according to the length of the sheet in the transport direction determined by the signal received at the sheet length reception means.

19. A sheet discharge apparatus according to claim 18, wherein said control means controls the elevator means to start at an earlier timing as the length of the sheet in the transport direction determined by the signal received at the sheet length reception means becomes shorter.

20. A sheet discharge apparatus according to claim 15, further comprising sheet size reception means for receiving a signal from the image forming apparatus, said signal indicating a size of the sheet, said control means controlling the elevator means to raise and lower the storage means at a different speed according to the size of the sheet determined by the signal received at the sheet size reception means.

21. A sheet discharge apparatus according to claim 20, wherein said control means controls the elevator means to raise and lower the storage means at a faster speed as the size of the sheet determined by the signal received at the sheet size reception means becomes smaller.

22. A sheet discharge apparatus according to claim 15, further comprising sheet length reception means for receiving a signal from the image forming apparatus, said signal indicating a length of the sheet in a transport direction, said control means controlling the elevator means to raise and lower the storage means at a different speed according to the length of the sheet in the transport direction determined by the signal received at the sheet length reception means.

23. A sheet discharge apparatus according to claim 22, wherein said control means controls the elevator means to raise and lower the storage means at a higher speed as the length of the sheet in the transport direction determined by the signal received at the sheet length reception means becomes shorter.

* * * * *